US010974744B2

(12) United States Patent
Forés Ràfols

(10) Patent No.: US 10,974,744 B2
(45) Date of Patent: Apr. 13, 2021

(54) SWITCH SYSTEM FOR RAIL-GUIDED VEHICLE-BASED TRANSPORT SYSTEMS

(71) Applicant: Mecalux, S.A., Barcelona (ES)

(72) Inventor: Albert Forés Ràfols, Barcelona (ES)

(73) Assignee: Mecalux, S.A., Barcelona (ES)

( * ) Notice: Subject to any disclaimer, the term of this patent is extended or adjusted under 35 U.S.C. 154(b) by 309 days.

(21) Appl. No.: 16/178,139

(22) Filed: Nov. 1, 2018

(65) Prior Publication Data

US 2019/0126955 A1 May 2, 2019

(51) Int. Cl.
*B61L 1/18* (2006.01)
*E01B 25/26* (2006.01)

(52) U.S. Cl.
CPC ..... *B61L 1/181* (2013.01); *E01B 25/26* (2013.01)

(58) Field of Classification Search
CPC ..... B61L 1/181; E01B 25/00; E01B 25/12; E01B 25/26
See application file for complete search history.

(56) References Cited

U.S. PATENT DOCUMENTS 582,436 A * 5/1897 Ridgway ..... B65G 9/008 104/99
767,864 A 8/1904 Brown
768,239 A * 8/1904 Richards ..... B61J 1/06 104/99
1,403,853 A * 1/1922 Ferris ..... B61L 23/002 104/99
2,211,220 A * 8/1940 Verplanck ..... B60M 1/14 104/35
4,109,584 A * 8/1978 Mihirogi ..... E01B 25/00 104/101
4,416,202 A * 11/1983 Rooklyn ..... B61B 13/00 104/130.01
5,440,996 A * 8/1995 Cottino ..... A63H 19/30 104/35
6,102,770 A * 8/2000 Cyrus ..... A63H 18/14 446/129
6,877,438 B2 * 4/2005 Olbort ..... B60S 13/02 104/35

(Continued)

FOREIGN PATENT DOCUMENTS

| | | |
|---|---|---|
| ES | 2398565 | 3/2013 |
| GB | 886454 | 1/1962 |
| RU | 2527253 | 8/2014 |

OTHER PUBLICATIONS

Spanish Search Report and Written Opinion dated Jun. 27, 2018 issued in corresponding Spanish Application No. 201731276.

*Primary Examiner* — Jason C Smith
(74) *Attorney, Agent, or Firm* — Amster, Rothstein & Ebenstein LLP

(57) ABSTRACT

A switch system for rail-guided vehicle-based transport systems includes a turntable provided with a single straight rail and a single curved rail integral with said turntable, said turntable being rotatable about a rotating shaft, said rotating shaft being arranged such that it is shifted with respect to said straight rail and said curved rail. The switch system is simple and economical and prevents vehicles from stopping as they approach the switch system when the switch system changes its position, and allows the free passage of the vehicle, without the rails hindering the passage of the wheels of the vehicle.

13 Claims, 3 Drawing Sheets

(56) References Cited

U.S. PATENT DOCUMENTS

| | | | | |
|---|---|---|---|---|
| 8,302,536 | B1 * | 11/2012 | Meinzinger | E01B 7/00 104/102 |
| 8,398,031 | B2 * | 3/2013 | Gawelczyk | E01B 23/06 246/415 R |
| 10,500,123 | B2 * | 12/2019 | Glukhovsky | A61H 3/008 |
| 2010/0000440 | A1 * | 1/2010 | Meinzinger | E01B 7/00 104/102 |
| 2010/0147183 | A1 * | 6/2010 | Weissbrodt | E01B 23/06 104/307 |
| 2010/0163688 | A1 * | 7/2010 | Blum | B61L 5/065 246/219 |
| 2019/0126955 | A1 * | 5/2019 | Fores R Fols | E01B 25/26 |

* cited by examiner

SWITCH SYSTEM FOR RAIL-GUIDED VEHICLE-BASED TRANSPORT SYSTEMS

CROSS-REFERENCE TO RELATED APPLICATION

This application claims priority to Spanish Patent Application No. P201731276, filed Nov. 2, 2017, the entire content of which are hereby incorporated by reference herein in their entirety.

FIELD OF THE DISCLOSURE

The present invention relates to a switch system for rail-guided vehicle-based transport systems, particularly in self-propelled vehicles.

BACKGROUND OF THE INVENTION

In the field of materials handling, there are different ways of moving the loads into a warehouse. One of the various systems is the so-called floor-mounted electrified monorails or rail-guided vehicles. These systems are in charge of moving loads between different areas of installations on vehicles, whether from one side of the warehouse to the other, or in connection with moving loads from production areas towards the warehouse.

In rail-guided vehicles systems, the vehicles travel along rails, the circuit can be a closed loop without alternative tracks, or rotatable-type switch systems can be used.

When switch systems are used, the vehicle must stop as it approaches the switch, the switch system rotates in order to orient it as desired, and once it has been oriented correctly, the vehicle moves again. This entails a significant loss of time in each cycle.

These switch systems normally comprise a rotatable turntable provided with rails, and the position of the rotatable turntable depends on the path the vehicle is to take.

An example of switch systems of this type is described in patent document US 2010147183 A1, which relates to a switch system provided with two straight rails and two curved rails which are mounted on a rotatable turntable and allow defining a plurality of positions.

Therefore, an objective of the present invention is to provide a switch system for rail-guided vehicle-based transport systems that is as simple and as economical as possible, that prevents vehicles from stopping as they approach the switch system when said switch system changes its position, and allows the free passage of the vehicle, without the rails hindering the passage of the wheels of the vehicle.

DESCRIPTION OF THE INVENTION

The aforementioned drawbacks are successfully resolved with the switch system of the invention, while having other advantages that will be described below.

The switch system for rail-guided vehicle-based transport systems according to the present invention comprises a turntable provided with a straight rail and a curved rail integral with said turntable, said turntable being rotatable about a rotating shaft, and characterized in that the switch system only has one straight rail and one curved rail, said rotating shaft being arranged such that it is shifted with respect to said straight rail and said curved rail.

Advantageously, said rotating shaft is arranged between the straight rail and the curved rail, and according to a preferred embodiment, said rotating shaft is arranged equidistantly from the respective midpoints of the straight rail and of the curved rail.

The switch system for rail-guided vehicle-based transport systems according to the present invention also advantageously comprises a motor driving the rotatable turntable, said motor being mounted on the rotatable turntable.

According to a preferred embodiment, the turntable has a rectangular layout defining first and second long sides and first and second short sides, the straight rail being arranged next to the first long side and the curved rail being placed such that it passes through the corners defined by the second long side and the first and second short sides, and the motor is preferably mounted on the second long side.

Advantageously, said turntable comprises a plurality of wheels, and said wheels are preferably facing the rotating shaft, and arranged on the long sides of the turntable.

Said turntable is preferably rotatable between a plurality of positions, said positions being shifted 45° from one another. Particularly, it can be placed in a first position, in which position the straight rail is used, in a second position, shifted 45° with respect to the first position in one direction, and in a third position, shifted 45° with respect to the first position in the opposite direction, in which positions the curved rail is used.

With the switch system for rail-guided vehicle-based transport systems according to the present invention, at least the following advantages are achieved:

- the vehicle used in the transport system is prevented from stopping before reaching the switch system, where it can perform a continuous movement, with the subsequent time savings;
- using a single straight rail and a single curved rail simplifies the system and lowers its cost;
- the arrangement of the rotating shaft such that it is shifted with respect to the rails allows the rotation of the turntable not to affect the passage of the vehicle, specifically its wheels; and
- the placement of the motor mounted on the rotatable turntable itself also allows the rotation of the turntable not to affect the passage of the vehicle.

BRIEF DESCRIPTION OF THE DRAWINGS

To better understand the preceding description, a set of drawings is attached in which a practical embodiment is shown schematically and merely by way of non-limiting example.

DESCRIPTION OF A PREFERRED EMBODIMENT

Figure 1:
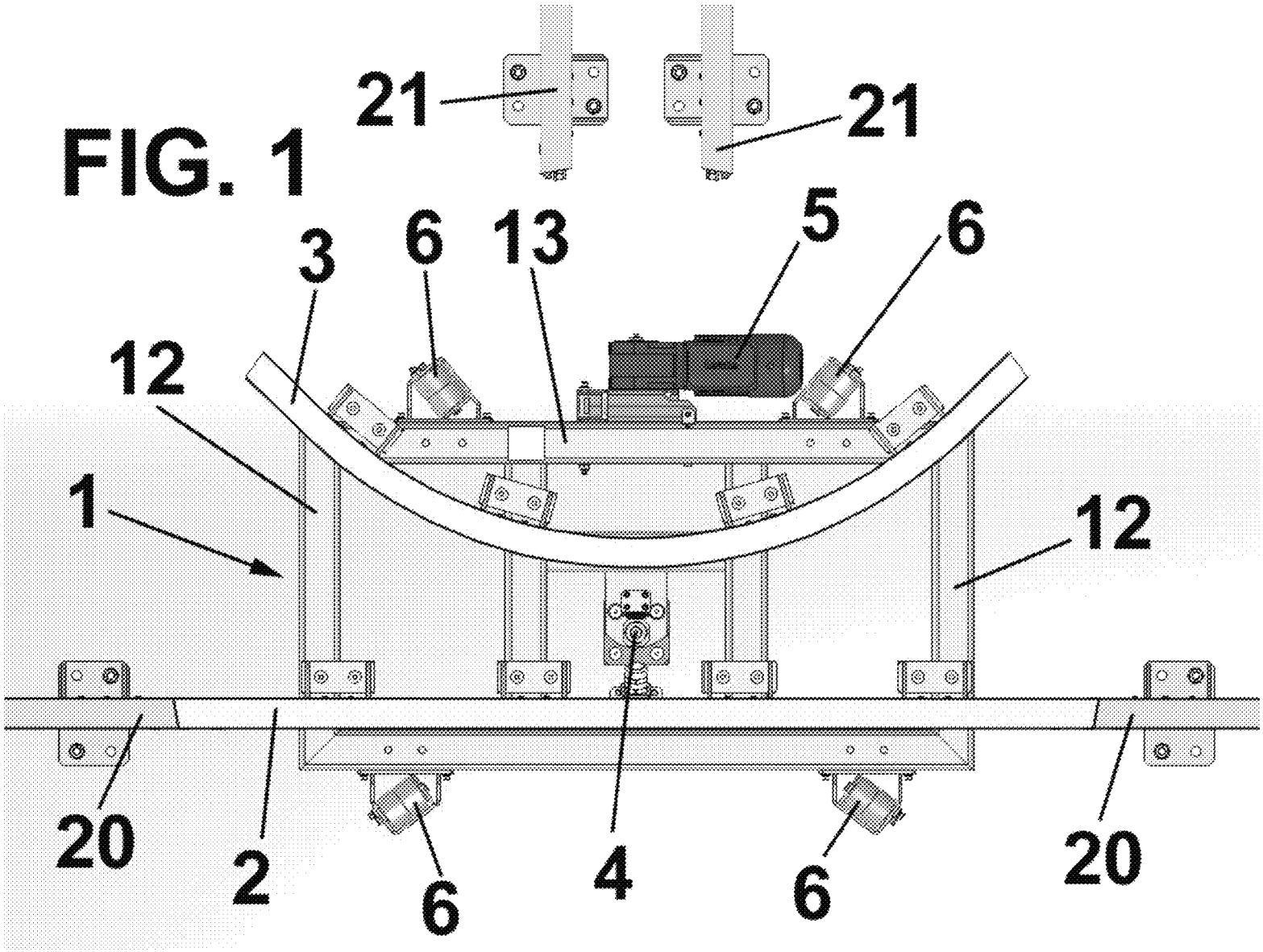
FIG. 1 is a plan view of the switch system according to the present invention, in a first position.

As is shown in the drawings, the switch system for rail-guided vehicle-based transport systems according to the present invention comprises a turntable 1 provided with a single straight rail 2 and a single curved rail 3 which are integral in rotation with said turntable, such that they rotate as the turntable 1 rotates.

Said turntable 1 is rotatable about a rotating shaft 4 which, in the usage position, is substantially vertical, since the turntable is supported on the floor, for example, of a warehouse.

Said rotating shaft 4 is arranged such that it is shifted with respect to said rails; particularly, it is arranged between said straight rail 2 and said curved rail 3, more specifically at the same distance from both rails 2, 3 and aligned with the midpoints of the straight rail 2 and of the curved rail 3, as can be seen in the drawings.

The turntable 1 according to the depicted embodiment has a rectangular layout, although it could be of any other suitable shape, and defines a first long side 11, a second long side 13, and two short sides 12.

According to this embodiment, the straight rail 2 is arranged next to the first long side 11, whereas the curved rail 3 is arranged such that it passes through the corners defined by the second long side 13 and the short sides 12 of the turntable 1.

In order to rotate, the turntable 1 comprises a motor 5 mounted thereon, which rotates with the turntable 1 as it is integral therewith. Said motor 5 according to the depicted embodiment is mounted on the second long side 13 of the turntable 1.

The turntable 1 also comprises a plurality of wheels 6 in order to rotate. These wheels are arranged on the long sides 11, 13 of the turntable, according to the depicted embodiment.

Particularly, the wheels 6 are grouped in pairs and aligned with the rotating shaft 4 of the turntable 1, i.e., the extension of the rotating shaft of each pair of wheels 6 crosses the rotating shaft 4 of the turntable 1, the assembly of wheels 6 defining a path circular when said turntable 1 rotates.

It must be indicated that the switch system according to the present invention is specifically designed to be used with rail-guided self-propelled vehicles (not depicted in the drawings), comprising four wheels, two of which are guided by the rails and the other two travel along the floor. This type of vehicle is not described in detail because it is not part of the present invention and because they are known by those skilled in the art.

Figure 2:
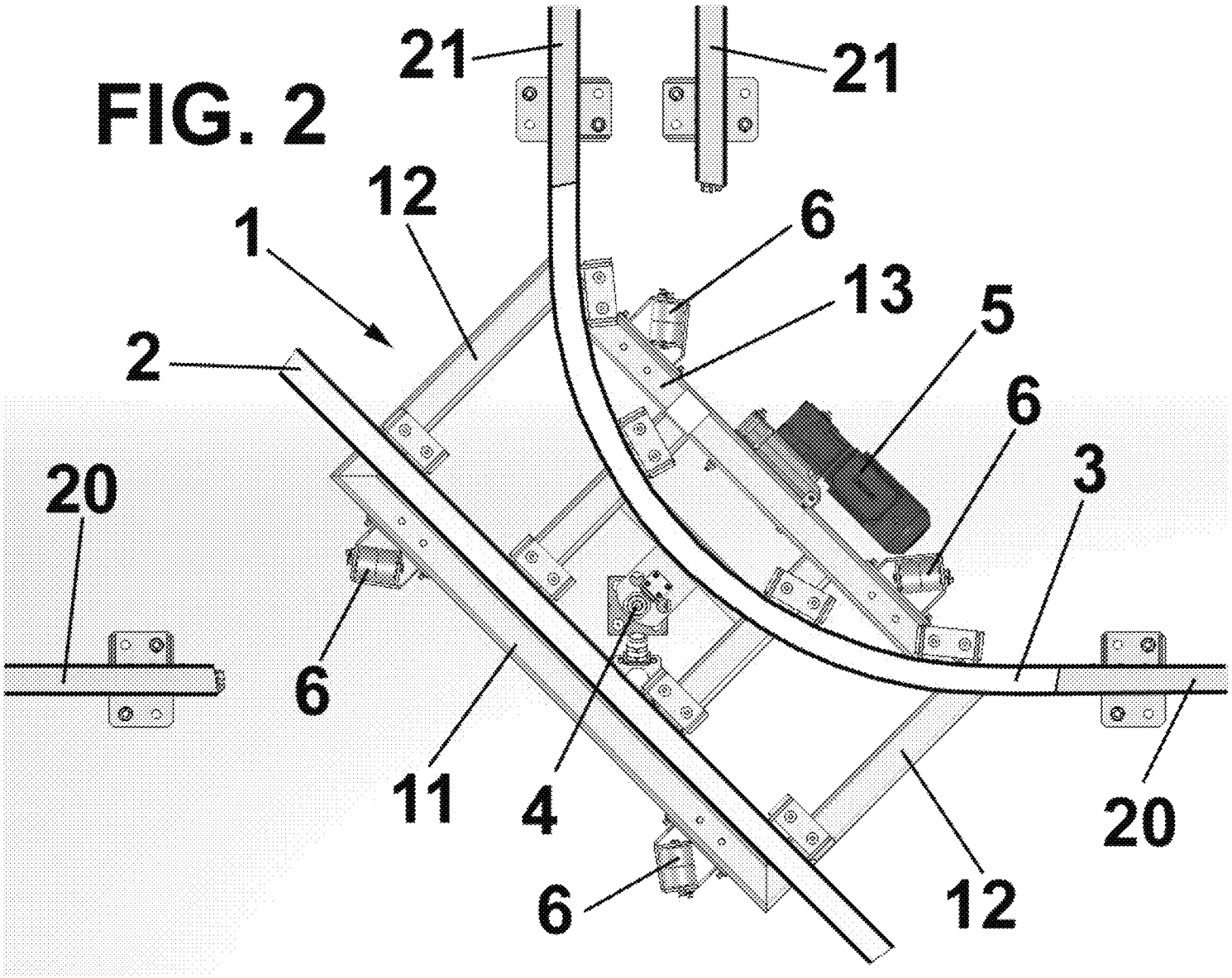
FIG. 2 is a plan view of the switch system according to the present invention, in a second position.
Figure 3:
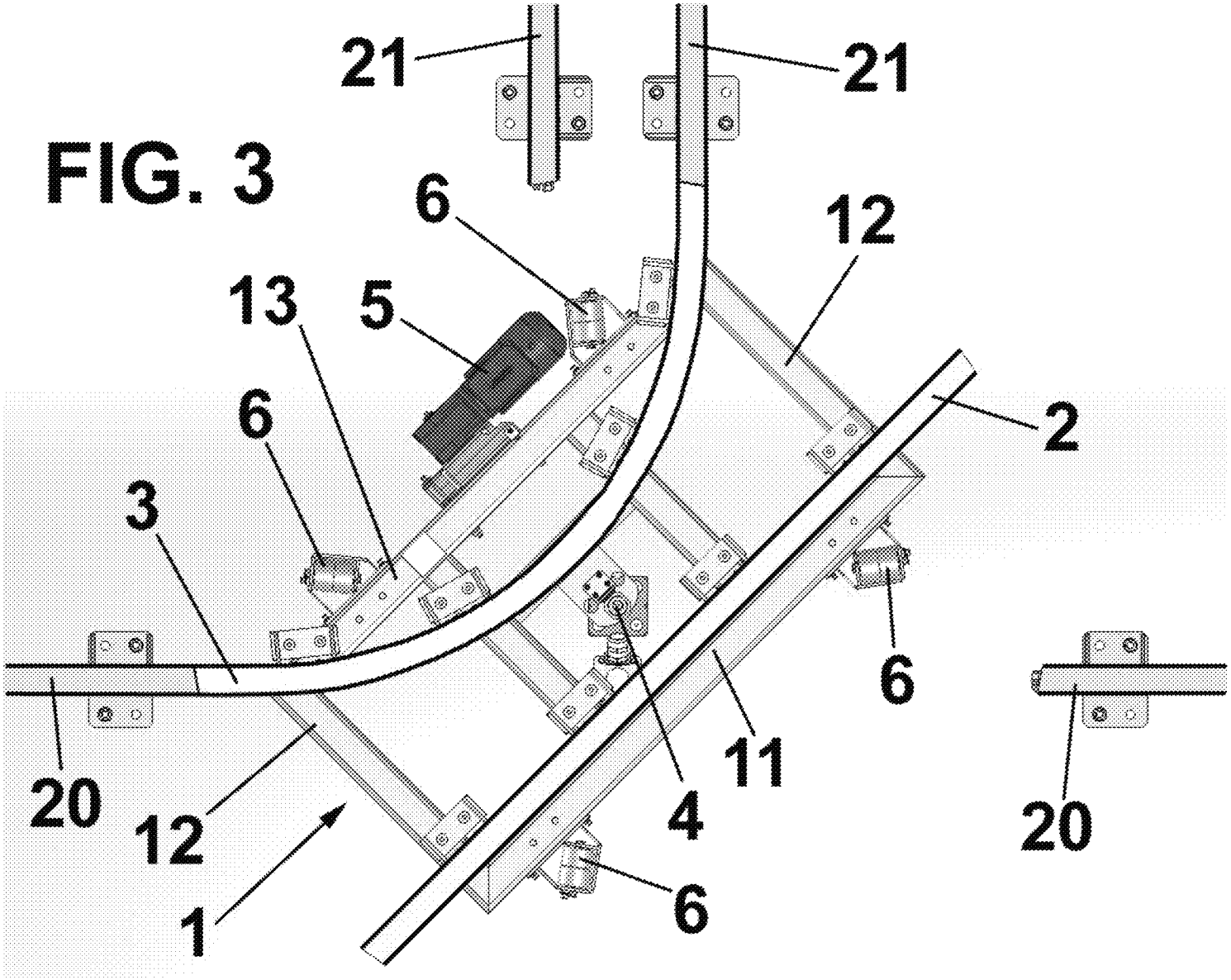
FIG. 3 is a plan view of the switch system according to the present invention, in a third position.

The switch system according to the present invention can be placed in a plurality of positions; specifically, it can be placed in the three positions that are shown in FIGS. 1 to 3.

A first position of the switch system is shown in FIG. 1, and in this position the straight rail is used 2 for guiding the corresponding vehicle. As shown in this drawing, the straight rail 2 will be aligned and connect with first rails 20 that are fixed in the transport installation.

A second position of the switch system is shown in FIG. 2, and in this position the curved rail is used 3 for guiding the corresponding vehicle. In this position, the curved rail 3 connects one of said first fixed rails 20 with a second, also fixed rail 21 of the installation. With respect to the first position shown in FIG. 1, this second position has been shifted 45° clockwise.

A third position of the switch system is shown in FIG. 3, and in this position the curved rail is used 3 for guiding the corresponding vehicle. In this position, the curved rail 3 connects one of said first fixed rails 20 with another second, also fixed rail 21 of the installation. With respect to the first position shown in FIG. 1, this second position has been shifted 45° counter-clockwise.

Evidently, the switch system also comprises computerized control means to control the path the vehicles are to describe, without having to stop prior to changing the path by means of the switch system according to the present invention.

Despite having referred to a specific embodiment of the invention, it is evident for one skilled in the art that the switch system that has been described may be subject to a number of variations and modifications, and that all the details that have been mentioned can be replaced with other technically equivalent ones without departing from the scope of protection defined by the attached claims.

What is claimed is:

1. A switch system for rail-guided vehicle-based transport systems, comprising:

a turntable provided with a single straight rail and a single curved rail integral with said turntable, said turntable being rotatable about a rotating shaft, said rotating shaft being arranged such that it is shifted with respect to said straight rail and said curved rail, and wherein said rotating shaft is arranged between the straight rail and the curved rail and is arranged equidistantly from respective midpoints of the straight rail and of the curved rail.

2. A switch system for rail-guided vehicle-based transport systems according to claim 1, further comprising a motor driving the turntable, said motor being mounted on the turntable.

3. A switch system for rail-guided vehicle-based transport systems according to claim 2, wherein the turntable has a rectangular layout defining first and second long sides and first and second short sides, the straight rail being arranged next to the first long side and the curved rail being placed such that it passes through the corners defined by the second long side and the first and second short sides.

4. A switch system for rail-guided vehicle-based transport systems according to claim 2, wherein the motor is mounted on the second long side.

5. A switch system for rail-guided vehicle-based transport systems according to claim 1, wherein said turntable comprises a plurality of wheels.

6. A switch system for rail-guided vehicle-based transport systems according to claim 5, wherein said plurality of wheels are oriented towards the rotating shaft.

7. A switch system for rail-guided vehicle-based transport systems according to claim 5, wherein the turntable has a rectangular layout defining first and second long sides and first and second short sides, the straight rail being arranged next to the first long side and the curved rail being placed such that it passes through the corners defined by the second long side and the first and second short sides and wherein the plurality of wheels of the turntable are arranged on the long sides of the turntable.

8. A switch system for rail-guided vehicle-based transport systems according to claim 1, wherein said turntable is rotatable between a plurality of positions, each position of said plurality of positions being shifted 45° from each other position of the plurality of positions.

9. A switch system for rail-guided vehicle-based transport systems according to claim 1, further comprising a motor driving the turntable, said motor being mounted on the turntable.

10. A switch system for rail-guided vehicle-based transport systems according to claim 1, further comprising a motor driving the turntable, said motor being mounted on the turntable.

11. A switch system for rail-guided vehicle-based transport systems according to claim 1, wherein the turntable has a rectangular layout defining first and second long sides and first and second short sides, the straight rail being arranged next to the first long side and the curved rail being placed such that it passes through the corners defined by the second long side and the first and second short sides.

12. A switch system for rail-guided vehicle-based transport systems according to claim 1, wherein the turntable has a rectangular layout defining first and second long sides and first and second short sides, the straight rail being arranged next to the first long side and the curved rail being placed such that it passes through the corners defined by the second long side and the first and second short sides.

13. A switch system for rail-guided vehicle-based transport systems according to claim 1, wherein the turntable has a rectangular layout defining first and second long sides and first and second short sides, the straight rail being arranged next to the first long side and the curved rail being placed such that it passes through the corners defined by the second long side and the first and second short sides.

* * * * *